United States Patent [19]

Calvert

[11] Patent Number: 4,819,294

[45] Date of Patent: Apr. 11, 1989

[54] PAD-TYPE APPLICATOR WITH ADJUSTING HANDLE

[75] Inventor: Peter W. Calvert, Johnson City, Tenn.

[73] Assignee: Thomas Industries, Inc., Louisville, Ky.

[21] Appl. No.: 22,680

[22] Filed: Mar. 6, 1987

[51] Int. Cl.[4] ..... B05C 17/00; B05C 1/06

[52] U.S. Cl. ..... 15/209 R; 15/144 R; 15/210 R; 16/DIG. 24; 16/DIG. 39

[58] Field of Search ..... 15/144 R, 209 R, 210 R; 16/115, DIG. 24, DIG. 25, DIG. 39, 112; 403/93, 96, 97; 24/68 CD, 71.2, 69 R

[56] References Cited

U.S. PATENT DOCUMENTS 1,847,133 3/1932 Nieman ..... 403/96

2,052,331 8/1936 White ..... 403/93

3,717,896 2/1973 Chase ..... 15/210 R 4,620,813 11/1986 Lacher ..... 403/93

*Primary Examiner*—Harvey C. Hornsby

*Assistant Examiner*—K. L. O'Leary

*Attorney, Agent, or Firm*—Emrich & Dithmar

[57] ABSTRACT

A pad-type paint applicator includes a base adapted to releaseably receive a paint applicator pad, and a handle assembly removably attachable to the base and including an adjustment mechanism which permits the handle to be locked in virtually any position between a position with the handle located normal to the base and a position with the handle located parallel to the base, the locking mechanism including a serrated surface at the base of the handle adapted to be driven into engagement with a complementary serrated surface on the upper surface of the base.

11 Claims, 3 Drawing Sheets

PAD-TYPE APPLICATOR WITH ADJUSTING HANDLE

BACKGROUND OF THE INVENTION

This invention relates to paint applying apparatus of the pad applicator type, and more particularly to an improved pad-type paint applicator with an adjusting handle.

Pad-type paint applicators provide a generally planar paint applying surface, and are particularlay suitable for painting shingles and lapped siding as well as vertical walls and ceilings and the like. Most pad-type paint applicators have a relatively short gripping handle, in the order of 6–8 inches long, but are adapted for use with an extension pole to allow the user to paint walls or ceilings. The particular angular relationship between the short gripping handle and the applicator pad permits the user to easily paint those surfaces within arms length without requiring strenuous physical exertion or causing unnecessary fatigue. The short handle is also very suitable and at the proper angle for painting nearby surfaces. However, an extension pole must be used to extend the reach of the user when painting remote surfaces, such as the upper portions of walls or ceilings.

Because the pad must be flush against the surface being painted, pad painters have incorporated adjusting handles to permit increase in the length of the stroke which can be painted. One prior art pad-type paint applicator shown in U.S. Pat. No. 3,473,183 which was issued on Oct. 31, 1969, had a handle which was pivotally movable relative to the base on which the pad is mounted. A locking member locked the handle in one of two paint applying modes or permitted free pivotal movement of the handle relative to the base. In another known pad-type paint applicator, the adjusting handle was adapted to lock in 90° increments. The mounting end of the handle pivoted about a screw and was tightened in place by a way of a wing nut. While these arrangements afforded adjustment in the angle of the handle, the adjustment was provided in fixed increments limiting the effectiveness of the handle adjustment.

Another known pad-type paint applicator included a twist-lock adjusting handle having its mounting end pivotally attached at the base between a pair of upstanding mounting flanges by a pivot pin. The flanges were generally semi-circular in shape and had serrated peripheral edges which cooperated with a locking surface near the bottom end of the handle. The handle was pivoted to the desired angle and then rotated to move the locking surface into engagement with the serrated edges of the mounting flanges. Although this arrangement provided a greater degree of flexibility in positioning of the angle of the handle, the handle was fixedly attached to the pad holder.

SUMMARY OF THE INVENTION

It is a general object of the invention to provide an improved pad-type paint applicator.

Another object of the invention is to provide pad-type paint applicator with an adjusting handle which is removably attached to the pad holder.

Another object of the invention is to provide pad-type paint applicator having an adjusting handle which is fixedly adjustable to a large number of positions.

These and other objects of the invention are achieved by the present invention which has provided a pad holder assembly for releasably receiving a paint applicator pad, the pad holder assembly comprising a base and a handle constructed and arranged to be releasably attached to the base for pivotal moveement relative to the base. The base has a top wall with a recess formed in the upper surface thereof. The recess has opposing side surfaces and a concave generally arcuate surface extending between the side surfaces with serrations formed on at least a portion of the arcuate surface.

The side surfaces include arcuate rib portions extending into the recess in overlying relation with the edges of the arcuate surface defining guide channels at opposite sides of the recess. An attachment means releasably secures the applicator pad to the base.

The handle includes a hand grip portion and a mounting portion at one end of the hand grip portion.

The mounting portion includes first and second arcuate guide means on opposite outer side surfaces of the mounting portion constructed and arranged to be received in the guide channels of the recess for attaching the handle to the base, permitting pivotal movement of the handle relative to the base.

The mounting portion has locking means including a convex arcuate tongue member cantilever mounted on the mounting portion at the bottom thereof and a convex arcuate outer surface overlying the concave serrated surface of the recess and having a plurality of serrations thereon. A cam means is pivotally mounted on the mounting portion for movement between first and second positions to drive the serrated outer surface of the tongue portion into and out of engagement, respectively, with the serrated surface of the recess.

The handle is pivotally movable relative to the base when the locking means is at the first position, and the handle is locked in position when the locking means is at the second position.

The invention consists of certain novel features and structural details hereinafter fully described, illustrated in the accompanying drawings, and particularly pointed in the appended claims, it being understood that various changes in the details may be made without departing from the spirit, or sacrificing any of the advantages of the present invention.

DESCRIPTION OF THE DRAWINGS

For the purpose of facilitating and understanding the invention, there is illustrated in the accompanying drawings a preferred embodiment thereof, from an inspection of which, when considered in connection with the following description, the invention, its construction and operation, and many of its advantage will be readily understood and appreciated.

DESCRIPTION OF PREFERRED EMBODIMENTS

Figure 1:
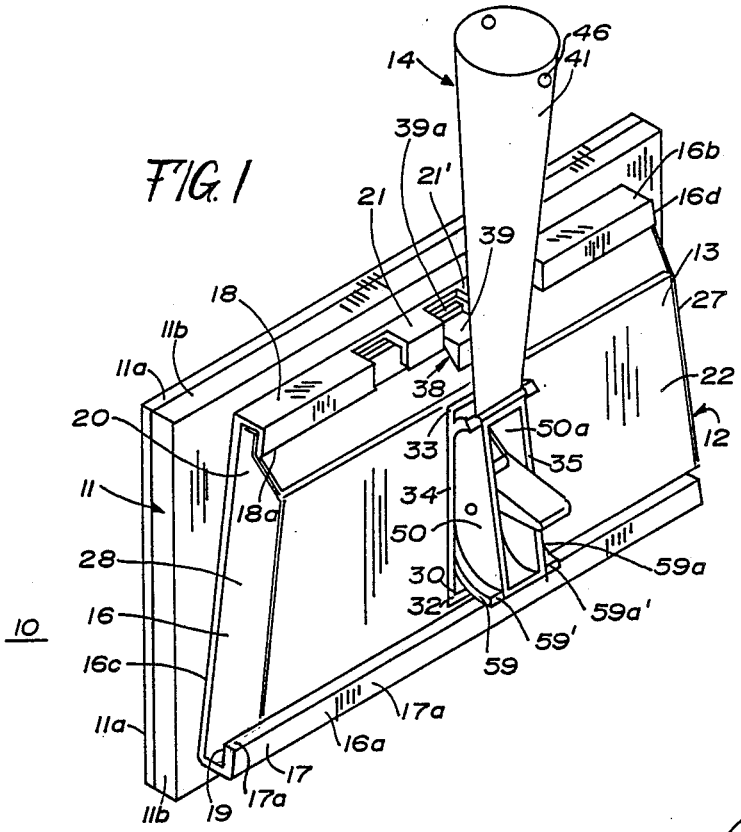
FIG. 1 is a perspective view of the pad-type paint applicator provided by the present invention.
Figure 2:
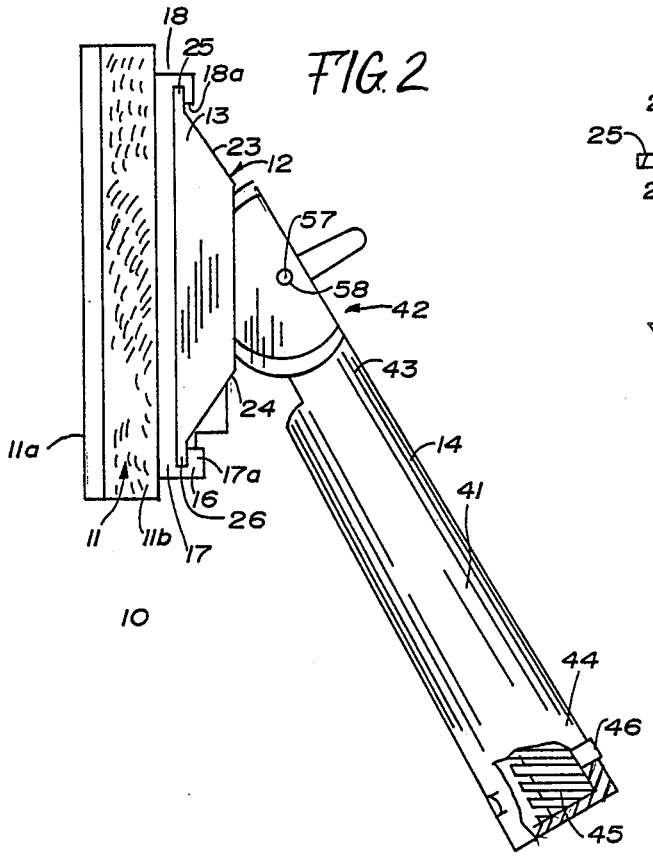
FIG. 2 is a side elevation view of the paint applicator shown in FIG. 1.
Figure 3B:
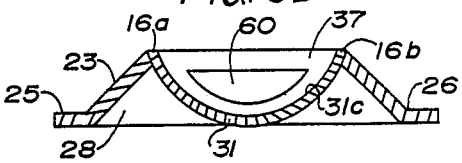
FIG. 3B is a sectional view taken along the lines 3B of FIG. 3A.
Figure 3A:
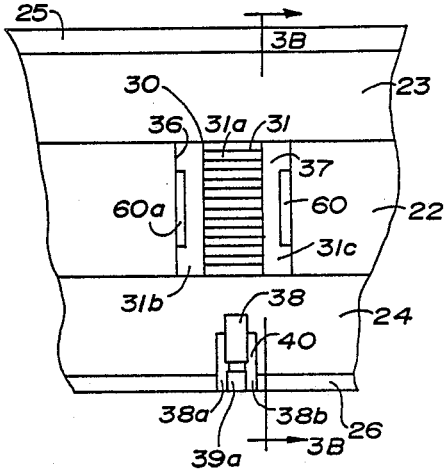
FIG. 3A is a fragmentary top plan view of the center portion of the base of the paint applicator.
Figure 3:
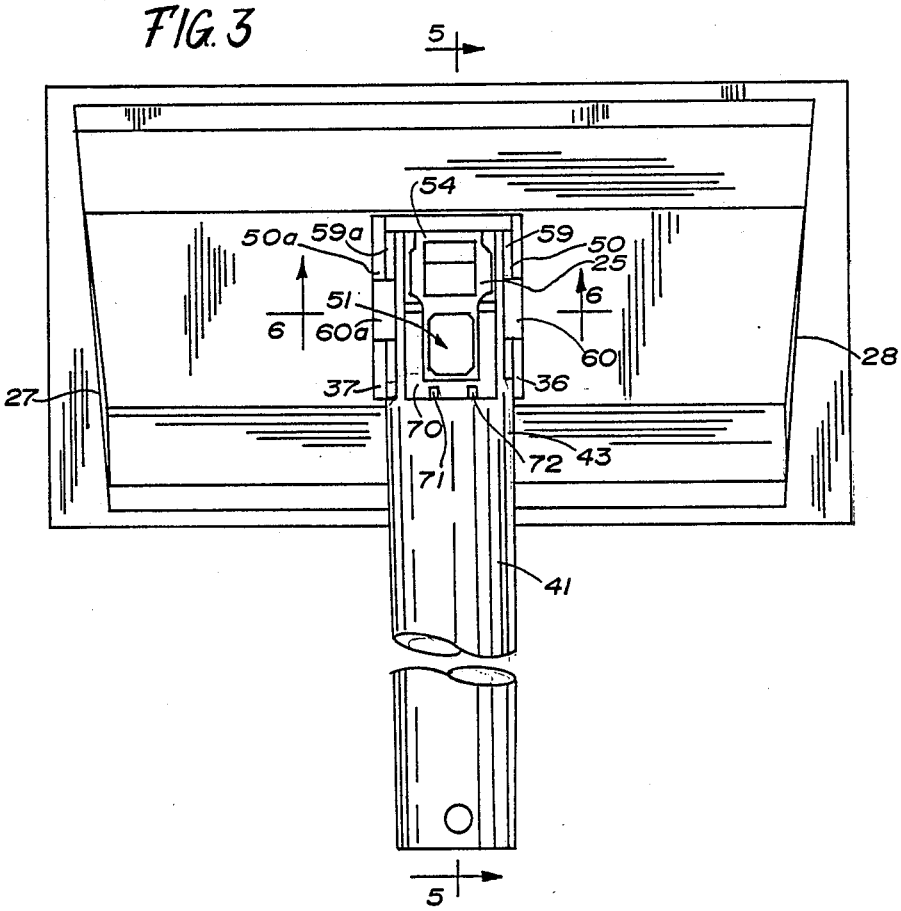
FIG. 3 is a top plan view of the paint applicator.

Referring to FIGS. 1–3, the pad-type paint applicator 10 provided by the present invention includes a pad 11 and a pad holder assembly 12 which includes a base 13 and a handle 14. The pad 11 is a laminated member including a nylon bristle paint receiving portion 11*a*, a foam backing portion 11*b* and an attachment plate 16 which facilitates attachment of the pad 11 to the holder assembly 12. The attachment plate 16 is a generally trapezoidal shaped member made from a rigid material such as plastic or metal. Plate 16 has parallel front and rear edges 16*a*, 16*b* and sides 16*c*, 16*d* which taper inward from the front edge 16*a* to the rear edge 16*b*. Upwardly extending side walls 17 and 18 are provided at the front and rear edges, respectively. The side walls 17 and 18 have respective grooves or channels 19 and 20 formed in opposing inner surfaces 17*a* and 18*a* thereof at the bases thereof. The two channels 19 and 20, which extend along the longitudinal edges of the plate 16, slidably receive the holder assembly 12 as will be described. At least one of the side walls, such as the rear side wall 18 is discontinuous providing posts 21 and 21' which define a plurality of locking positions spaced apart along rear edge 16*b* of the plate for confining a locking member of the holder assembly 12, to prevent relative movement between the pad and holder as will be shown.

Referring to FIGS. 1, 3 and 3A, and 3B, the base 13 of the pad holder assembly 12 is a hollow member having a generally trapezoidal cross section. The base 13 has a top wall 22 which is trapezoidal in shape, front and rear sloping walls 23,24 which extend downwardly from the top wall 22 to define front and rear flanges 25,26, which extend along the lateral edges of the base. The base 13 also has trapezoidal shaped side walls 27, 28, which taper inward in a rearward direction from the front to the rear edges of the base. The flanges 25, 26 are of sufficient height to be received snuggly in the channels 19 and 20 of the plate side walls 17 and 18.

The top surface 22 of the base has a recessed portion 30 at its center extending lengthwise from behind the front edge 16*a* to forward of the rear edge 16*b*, defining a locking and engaging surface for the handle assembly as will be shown. The recess 30 has a generally rectangular opening with parallel front and rear edges 32,33 and parallel side edges 34,35, and a concave generally arcuate bottom wall 31. The bottom wall 31 extends from one end of the opening to the other end of the opening of the recess and is flanked by two semi-circular side walls 36 and 37, such as side wall 37 shown in FIG. 3B. The recess 30 in the center of the top wall 22 extends substantially along the width of the top wall 22 of the base. The upper surface of the arcuate bottom wall 31 is serrated defining a plurality of teeth 31*a* as shown in FIG. 3A.

Figure 4:
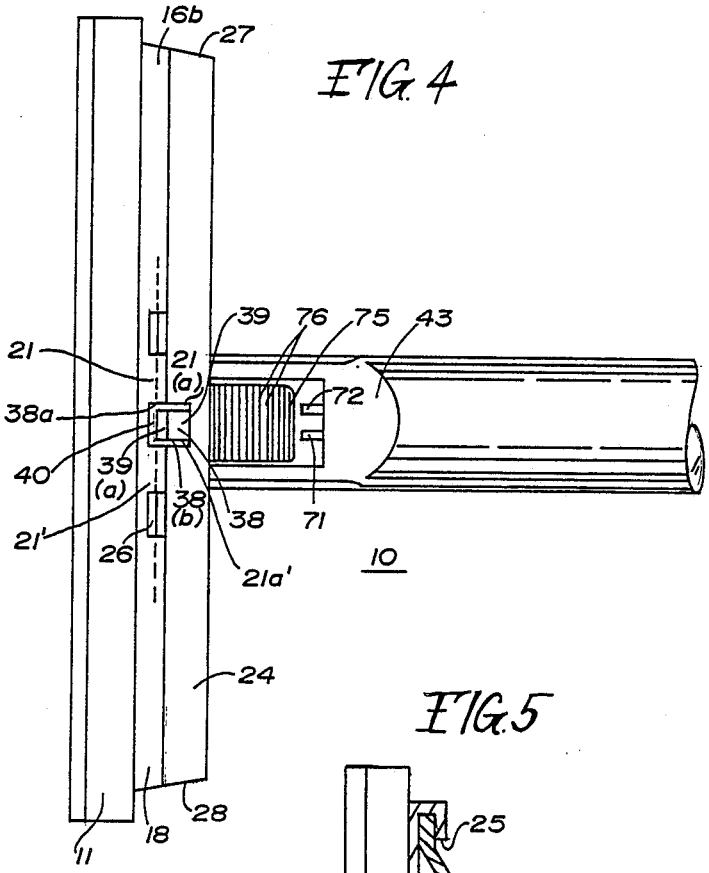
FIG. 4 is a front elevation view of the paint applicator.

Referring to FIGS. 1, 3A and 4, the sloping rear surface 24 of the base 13 has a locking member 38 projecting rearwardly therefrom defined by a portion of the rear surface 24 and rear flange 26 cutaway from the body 13 between slits 38*a* and 38*b*. The locking member 38 is thus cantilever mounted to the rear surface 24 near its upper edge and is pivotally movable relative to the base. The locking member has a stepped configuration including a raised generally rectangular finger portion 39 which extends upwardly beyond the planar extent of the rear surface 24 and is stepped down at its rear most edge defining a generally horizontal tab portion 39*a* which is located in a gap 40 at the center of the rear flange 26.

The locking member tab portion 39*a* extends between posts 21 and 21' at a height above the channel 20 in an interfering position relative to the inner side walls 21*a* and 21*a'* of the posts 21. Because the vertical height of the tab portion 39*a* corresponds to the height of the channel 20, if the pad is shifted left or right while the locking member 38 is in its normal or at rest position, the tab 39*a* may engage the side wall 21*a* or 21*a'* of one of the posts 21 or 21*a*, at a point above the channel 20 preventing relative movement between the pad and the base.

In assembling the pad to the holder 13, the locking member 38 is operated to its release position by depressing the finger portion 39. As finger portion 39 is depressed, it moves downwardly moving the tab portion 39*a* downwardly between the posts 21 and 21*a* and into alignment with the rear channel 20 at the base of the posts. This permits the pad to be slid onto the base with the tab portion 39*a* located within rear channel 20 in the plate 16. When the pad is centered on the pad holder and the locking member is released, the locking member restores to its rest position with the tab portion 39*a* returned to its interfering position under the force of the bias of the locking member 39. In its interfering position, the tab portion 39*a* may engage one of the vertical side walls 21*a* or 21*a'* of the posts 21 or 21*a*, preventing relative movement of the pad and holder assembly.

The base 13 is made of a rigid material such as plastic and is preferably molded as a one-piece unit.

Referring to FIGS. 1–3, the handle 14 includes a hollow generally tubular hand grip portion 41 having a mounting portion 42 at one end 43. The other end 44 of the hand grip portion 41 is provided with an internal thread 45 to facilitate connection of an extension pole (not shown) to the handle 14. An aperture 46 is provided through the end 44 to allow hanging of the pad assembly when not in use.

Referring to FIGS. 3 and 5–7, the mounting portion 42 has a hollow generally semi-cylindrical element 48 having a convex arcuate bottom wall 49, which is complementary to the concave curved bottom wall surface of the recess 30 (FIG. 6), and two parallel spaced opposing side walls generally semi-circular in shaped and numbered 50 and 50*a* respectively. The longitudinal axis of the semi-cylindrical element 48 extends transverse to the longitudinal axis of the hand grip portion of the handle.

Pivotally mounted within the semi-cylindrical element 48 is a locking member 51. Locking member 51 has a generally flat rectangular mounting portion 52 and an arcuate portion defining a convex cam surface 54. A lateral opening 56 through the mounting portion 52 defines a pivot surface which receives a pivot pin 57 which passes through aligned apertures 58 in upper portion of the side walls of the semi-cylindrical element 48.

The outer surfaces of side walls 50 and 50*a* are provided with arcuate shoulders 59 and 59*a*, respectively, which cooperate with ribs 60 and 60*a* on the side surfaces of the recess 30 and having arcuate lower surfaces which together with the peripheral edge portions of concave wall surface 31 define guide channels providing bearing surfaces between the removable handle 14 and the base 13.

Figure 8:
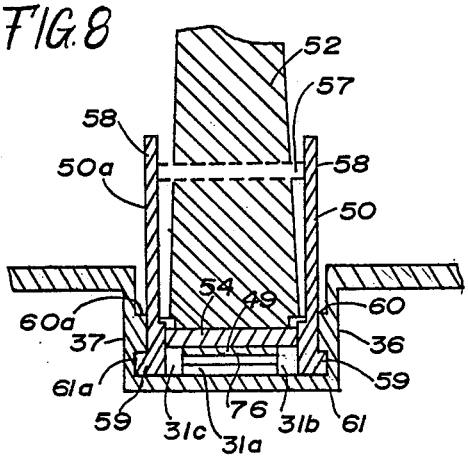
FIG. 8 is an enlarged fragmentary sectional view illustrating the handle locking mechanism.

As shown best in FIGS. 3, 3A and 8, the ribs 60 and 60*a* are located near the top and center of the side walls 36 and 37, respectively. The radius of curvature of the convex bottom surfaces of ribs 60 and 60*a* is complementary to that of the concave peripheral edge portions 31*b* and 31*c*, respectively of the recess defining arcuate guide channels 61 and 61*a* for the mounting portion of the handle. The forward or leading ends 59' and 59*a'* of the guide shoulders 59 and 59*a* may be tapered to facilitate insertion of the leading ends of the guide shoulders into the guide channels. The height of the guide shoulders 59 and 59*a* is slightly less than the height of the guide channels 61 and 61*a*, providing contacting bearing surfaces therebetween permitting sliding movement therealong without binding as the handle is rotated.

Considering the semi-cylindrical element 48 in more detail, with reference to FIGS. 3, 4A–4C and 5, the center portion of the bottom wall 49 of the semi-cylindrical element 48 is cut away at the end 62 nearest the hand grip portion 41 defining an arcuate tongue portion 63 which is cantilever mounted from the other end 65 of the bottom wall 49. The peripheral side edges 66 and 67 are spaced inwardly of the peripheral edges of the bottom wall 49 defining arcuate slots 68 and 69 therebetween. The free or forward end 64 of the tongue 63 is foreshortened defining a generally rectangular opening or space 70 between the free end 64 of the cantilever mounted tongue 63 and the end 43 of the hand grip portion 41. Located at end 43 of the hand grip portion 41 are two parallel ribs 71 and 72 which define stop surfaces for the locking member 51, limiting pivotal movement of the locking member 51 within the recess.

The bottom convex outer surface 75 of the bottom wall 49 is serrated defining a plurality of teeth 76. The serrated surface overlies and is adapted to be driven into engagement with the serrated inner concave arcuate wall of the recess 30 as will be shown.

Figure 4A:
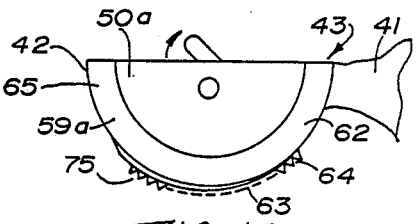
FIGS. 4A and 4B are side elevation view of the mounting portion of the handle with the locking member in the unlocking and the locking positions, respectively.
Figure 4B:
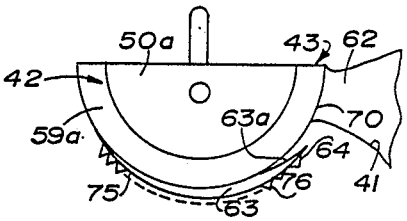
Figure 4C:
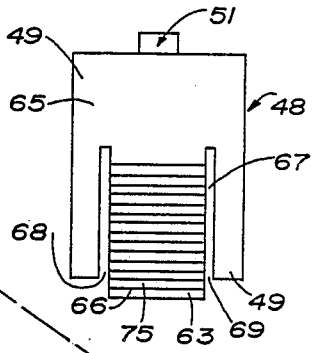
FIG. 4C is an end elevating view of the mounting portion of the handle.
Figure 5:
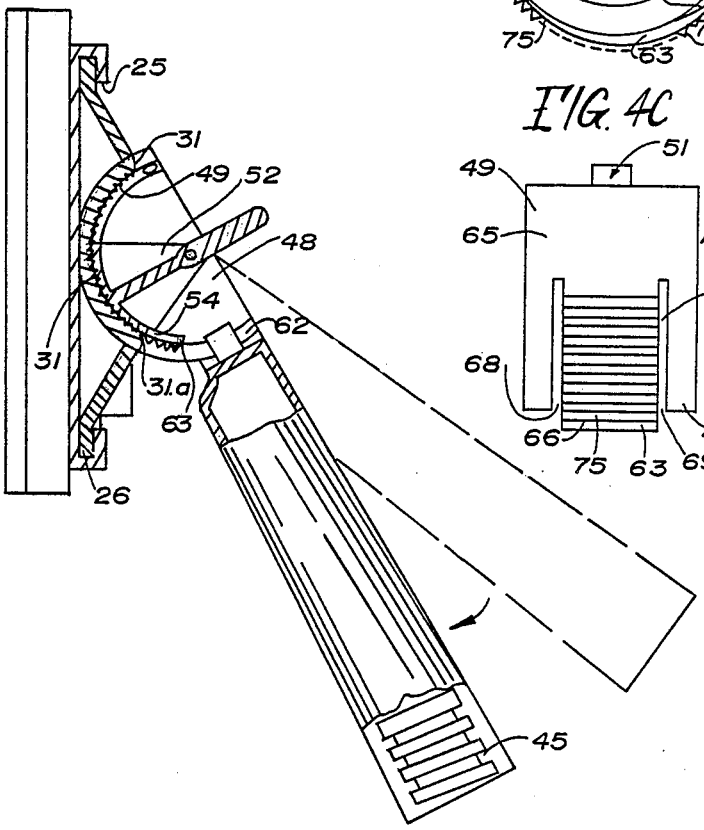
FIG. 5 is a sectional view taken along the lines 5—5 of FIG. 3.

Referring to FIGS. 4A and 4B, the length of the mounting portion 52 of the locking member 51 from the pivot pin 57 to its cam surface 54 is approximately the same as the radius of the semi-cylindrical element 48 such that when the locking member 51 is in its locking position (FIG. 4B), its cam surface 54 engages the upper surface 63*a* of the tongue 63 pivoting the tongue downwardly below the bottom of the semi-cylindrical portion 48. When the locking member 51 is in the unlocking position (FIG. 4A) the cam surface 54 is out of engagement with the tongue upper surface, allowing the tongue free end to flex upwardly, due to the resilience of the tongue, to lie substantially between the two side walls 50 and 50*a*.

Figure 7A:
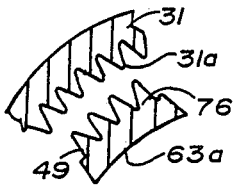
FIG. 7A is an enlarged fragmentary view illustrating the teeth in non-engaging relationship of the portion contained in the circle in FIG. 7.
Figure 6:
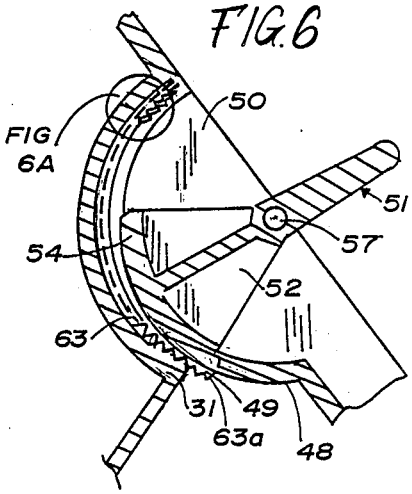
FIG. 6 is an enlarged fragmentary sectional view taken along the line 6—6 of FIG. 3.
Figure 7:
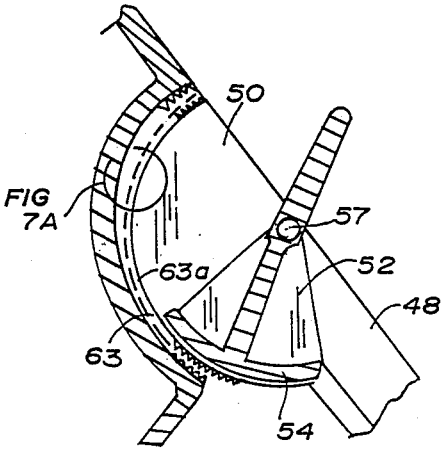
FIG. 7 is an enlarged fragmentary view similar to FIG. 6 but illustrating the locking mechanism in the unlocked position.
Figure 6A:
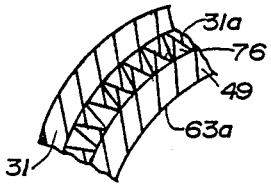
FIG. 6A is an enlarged fragmentary view showing the teeth in their engaged position as shown in the circle in FIG. 6.

Referring to FIGS. 6 and 7, in the locked position, illustrated in FIG. 6, the cam portion engages the upper surface 63*a* of the tongue 63, and maintains its convex serrated undersurface in engagement with the concave serrated upper surface of the recess such that its teeth 76 mesh, with the teeth 31*a*, as shown in FIG. 6A, locking the handle relative to the base. The locking member 52, by virtue of its mounting to the locking member 51, works against the undersurface of the guide ribs 60 and 60*a* on the base as the locking member is pivoted between its locking and unlocking positions.

When the locking member is pivoted to its unlocking position, illustrated in FIG. 7, the cam surface 54 is moved out of engagement with the free end of the tongue 64. This allows the tongue 63 to move upwardly under the force of its own resilience, moving its convex serrated surface out of engagement with the concave serrated upper surface of the recess, such that its teeth 76 are moved out of engagement with teeth 31*a* as illustrated in FIG. 7A, allowing the handle 14 to be pivoted relative to the base.

The handle is preferably made of the same material as the base, the hand grip portion 41 and the mounting portion 42, other than the locking member 51 and pivot pin 57, being an integral molded unit.

Thus, the upper surface of the recess in the base defines a plurality of serrations 31*a* and the undersurface of the bottom wall 49 of the handle mounting portion defines a cantilever mounted arcuate tongue 63 having a configuration complimentary to that of the recessed inner wall and provided with serrations 76. The radial length of the locking member 51 mounted within the semi-cylindrical element 48 corresponds to the length or radial extent of the semi-cylindrical portion such that when the locking member is operated from its unlocking position to its locking position, its cam surface 54 is moved to initially engage the upper surface 63*a* of the tongue 63 and to then ride along the upper surface with continued rotation of the locking member towards its locking position. As the locking member is pivoted towards its locking position, its cam surface drives the tongue 63 downwardly into engagement with the upper surface of the recess 30. This causes the serrations or teeth on the engaging surfaces to mesh as illustrated in FIG. 6A, locking the handle in position. It is evident that this locking arrangement provides a large number of incremental positions at which the handle can be locked between a position normal to the base 13 and a position parallel to the base 13.

With reference to FIGS. 2, 3, 3A and 5, to assemble the handle on the base, the user pivots the locking member 51 forward to its unlocking position and aligns the handle with the tapered ends 59', 59*a'* of the arcuate shoulders 59 and 59*a* on the mounting portion positioned at the inlets of respective channels 61 and 61*a* defined by the recess side walls.

Referring to FIGS. 7 and 7A, when the locking member 51 is in its unlocking position, cam surface 54 is out of engagement with the upper surface 63*a* of the tongue 63, allowing the tongue 63 to flex upward, out of engagement with the serrated surface of the recess, unlocking the handle 14.

The user then pivots the handle downwardly (clockwise in the direction of the arrow in FIG. 5) causing the leading end of the guide shoulders to ride along the guide channels. The handle is pivoted until the desired orientation of the handle relative to the top surface of the base is obtained. At such time, the locking member 51 is pivoted backwards to its locking position to drive the serrated undersurface of the tongue 63 into engagement with the serrated upper surface of the concave arcuate wall 31 of the recess 30 as shown in FIGS. 6 and 6A. When the locking member is operated from its unlocking position to its locking position, its cam surface 54 initially engages the upper surface of the tongue 63 and rides along the upper surface with continued rotation of the locking member towards its locking position. As the locking member is pivoted towards its locking position, its cam surface drives the tongue 63 downwardly into engagement with the upper surface of the recess 30. This causes the serrations or teeth on the engaging surfaces to mesh as illustrated in FIG. 6A, locking the handle in position.

After the handle has been locked in position, the positioning of the handle can be changed by merely pivoting the locking member to its unlocking position and rotating the handle clockwise or counterclockwise to the desired position. When the repositioning of the handle is achieved, the locking member is pivoted back to its locking position to lock the handle in that position.

Referring to FIGS. 1 and 4, to replace the pad, the finger portion 39 of the locking tab is depressed, moving the locking tab 39*a* into alignment with the channel 20 at the bases of posts 21 and 21*a* in the plate. The base can then be slid from the pad. To mount the replacement pad, the channels 19 and 20 are aligned to fit over the flanges 24 and 26 and the pad is slid onto the holder until tab portion of the locking member engages the outer edge of the plate. The finger portion 39 is then depressed, moving the tab portion 39*a* downward into alignment with the groove 20. The pad may then be slid onto the holder to locate the locking member 38 in alignment with the center slot 21. When the locking member 38 is released, the tab portion 39*a* rises upwardly into interfering engagement with the side walls 21*a*, 21*a*' of one the posts 21 and 21', preventing the pad from sliding out of the holder.

I claim:

1. A pad holder assembly for releasably receiving a paint applicator pad, said pad holder assembly comprising:

a base having an upper surface and a lower surface;

a handle including a hand grip portion and a mounting portion constructed and arranged for releasably attaching said handle to said base at its upper surface for pivotal movement relative to said base;

securing means for releasably securing the paint applicator pad to said base at its lower surface;

said base having a recess in its upper surface for attaching said handle to said base, said recess having serrations on a concave arcuate surface of said recess and guide means defining at least one guide channel for said handle;

said mounting portion of said handle including at least one guide member, and when said handle is assembled with said base, said guide member being located within said guide channel for movement along said guide channel as said handle is pivoted relative to said base;

and locking means operable to prevent pivotal movement of said handle relative to said base, said locking means including a locking member carried by said mounting portion and having a convex arcuate surface with a tongue portion having a convex outer surface overlying said concave serrated surface of said recess and being movable into and out of engagement with the serrated portion of said upper surface of said base, driving the serrated tongue portion into and out of engagement with said serrations on said base upper surface, and a lever means operatively coupled to said locking member for moving said locking member into and out of engagement with said serrated portion of said base upper surface.

2. A pad holder assembly according to claim 1, wherein said locking member is pivotally mounted on said mounting portion for movement between locking and unlocking positions to drive the serrated outer surface of said tongue portion into and out of engagement with the serrated surface of said recess.

3. A pad holder assembly according to claim 2, wherein said recess has opposing side surfaces and a concave generally arcuate surface extending between said side surfaces with said serrations on at least a portion of said arcuate surface, and said side surfaces including arcuate rib portions extending into said recess in overlying relation with the edges of said arcuate surface defining a first guide channel at one side of said recess and a second guide at the opposite side of said recess, said mounting portion of said handle having first and second guide members each received in a different one of said guide channels.

4. A pad holder assembly according to claim 3, wherein first and second guide members are arcuate in shape and formed on opposite outer side surfaces of said mounting portion and constructed and arranged to be received in said guide channels of aids recess for attaching said handle to said base, permitting pivotal movement of said handle relative to said base.

5. A pad holder assembly for releasably receiving a plain applicator pad, said pad holder assembly comprising:

a base having an upper surface and a lower surface;

a handle including a hand grip portion and a mounting portion constructed and arranged for releasably attaching said handle to said base at its upper surface for pivotal movement relative to said base;

securing means for releasably securing the paint applicator pad to said base at its lower surface;

said base having a recess in its upper surface for receiving and attaching said handle to said base and including guide means located within said recess and defining at least one guide channel for said handle;

said mounting portion of said handle including at least one guide member and when said handle is assembled with said base, said mounting portion extending into said recess with said guide member located within said guide channel for movement along said guide channel as said handle is pivoted relative to said base;

and locking means operable to prevent pivotal movement of said handle relative to said base, said locking means including serrations formed on a concave surface of said recess and a locking member carried by said mounting portion of said handle and movable into and out of engagement with said serrations formed in said recess, said mounting portion of said handle having first and second parallel side wall portions spaced apart from one another and a bottom wall including a bridging portion interconnecting said side wall portions and an arcuate tongue portion having a concave upper surface and a convex undersurface defining said locking member, said tongue portion extending in cantilever fashion from said bridging portion with its free end movable between a first position and second position, the free end of said tongue portion in said first position extending generally between said side wall portions, and the free end of said tongue portion in said second position projecting outwardly from the bottom of said mounting portion beneath said side wall portions, said undersurface, of said tongue portion including a plurality of serrations extending between said side wall portions and a lever means operatively coupled to said tongue portion for moving said serrated surface of said tongue portion into and out of engagement with said serrated surface of said recess.

6. A pad holder assembly according to claim 5, wherein said recess has first and second side wall portions with first and second guide channels, respectively on opposite sides of the recess, and wherein said side wall portions of said mounting portion have first and second guide members on the outside surfaces thereof which are received in said first and second guide channels in said side walls of said recess and cooperating therewith to allow pivoting movement of said handle relative to said base.

7. A pad holder assembly according to claim 6, wherein said locking member is pivotally mounted on said mounting portion and includes a lever arm having a tab portion projecting outwardly from the mounting portion at its upper edge and having am means carried on its lower end, said locking member being pivotally movable between locking and unlocking positions whereby when said locking member is in said unlocking position, said cam surface is out of engagement with said surface of said tongue portion, allowing said resilient tongue portion to move out of engagement with said serrated surface of said recess allowing pivotal movement of the handle relative to said base, and as said locking member is pivoted toward its locking position, said cam surface engaging and riding along said upper surface of said convex serrated undersurface of said tongue portion into engagement with the concave serrated upper surface of said recess to lock the handle in position.

8. In a pad-type paint applicator assembly, the combination comprising:

a paint applicator pad; and a pad holder assembly including a abuse and a handle;

said paint applicator pad including a paint receiving member and an attachment plate secured to said paint receiving member, said attachment plate having first and second edges defining a first edge pair;

said base having third and fourth edges defining a second edge pair aligned with edges of said first edge pair when said pad is assembled together with said pad holder, one edge pair including means defining channels for receiving edges of the other edge pair, and securing means on said base for cooperating with said edges on said pad to secure said pad to said pad holder;

said base having means on an upper surface thereof for attaching said handle to said base and including guide means defining at least one guide channel for said handle;

said handle having a hand grip portion and a mounting portion constructed and arranged for releasably attaching said handle to said base at an upper surface thereof for pivotal movement relative to said base;

said mounting portion of said handle including at least one guide member, and when said handle is assembled with said base, said guide member being located within said guide channel for movement along said guide channel as said handle is pivoted relative to said base, and locking means operable to prevent pivotal movement of said handle relative to said base, said locking means including a locking member carried by said mounting portion and movable into and out of engagement with a serrated portion of said upper surface of said base, and a lever means operatively coupled to said locking member for moving said locking member into and out of engagement with said serrated portion of said base upper surface;

said channel defining means being provided on said edges of said pad and the channel defining means on one edge including a discontinuous wall having plural sections spaced apart defining at least one gap therebetween, said securing means including a tab member extending into said gap and located in interfering relationship therewith, and means coupled to said tab member for moving said tab member into alignment with the edge receiving channel for said one edge.

9. A pad holder assembly for releasably receiving a paint applicator pad, said pad holder assembly comprising:

a base; and, a handle constructed and arranged for releasable attachment to said base;

said base having an upper surface and a lower surface;

means removably securing said paint applicator pad to said lower surface of said base;

said base upper surface having a recess formed therein extending between forward and rearward edges of said base, said recess having a concave generally arcuate surface with a plurality of serrations formed on at least a portion of said concave surface;

said handle assembly including a mounting portion and a hand grip portion;

said mounting portion including an element having a generally convex arcuate lower surface, said element cantilever mounted to the bottom portion of said mounting portion;

and lever means pivotally mounted on said mounting portion and having cam means extending in a juxtaposed relation with said element, said convex surface of said element having serrations on at least a portion thereof overlying the serrations on said concave surface of said recess, whereby as said lever means is pivotally moved from an unlocking position to a locking position, said cam means engages said element driving its serrated convex surface into engagement with the serrated concave surface of said recess to lock the handle in position.

10. A pad holder assembly for releasably receiving a paint applicator pad, said pad holder assembly comprising:

a base having front and rear walls, a pair of side walls and a top wall, said top wall having a recess in its outer surface centrally thereof with a concave arcuate surface and opposing side walls, said concave surface having a plurality of serrations extending between said side walls, each of said side walls having an arcuate guide channel formed therein;

attachment means for releasably securing the applicator pad to said base;

a handle including a hand grip portion and a mounting portion at one end of said hand grip portion, said mounting portion having first and second parallel side wall portions spaced apart from one another, and a bottom wall including a bridging portion interconnecting said side wall portions and an arcuate tongue portion having a concave upper surface and a convex undersurface, said tongue portion extending in cantilever fashion from said bridging portion with its free end movable between a first position and a second position, the free end of said tongue portion in said first position extending generally between said side wall portions and the free end of said tongue portion in said second position projecting outwardly from the bottom of said mounting portion beneath said side wall portions, said undersurface of said tongue portion including a plurality of serrations extending between said side wall portions, said side wall portions of said mounting portion having first and second guide means on the outside surfaces thereof which are received in the guide channels in said side walls of said recess and cooperating therewith to allow pivoting movement of said handle relative to said base; and a locking member pivotally mounted on said mounting portion and including a lever arm having a tab portion projecting outwardly from the mounting portion at its upper edge and having cam means carried on its lower end, said locking member being pivotally movable between locking and unlocking positions whereby when said locking member is in said unlocking position, said cam surface is out of engagement with said upper surface of said tongue portion, allowing said resilient tongue portion to move out of engagement with said serrated surface of said recess allowing pivotal movement of the handle relative to said base, and as said locking member is pivoted toward its locking position, said cam surface engaging and riding along said upper surface of said convex serrated undersurface of said tongue portion into engagement with the concave serrated upper surface of said recess to lock the handle in position.

11. A pad holder assembly for releasably receiving a paint applicator pad, said pad holder assembly comprising:

a base, a handle constructed and arranged to be releasably attached to said base for pivotal movement relative to said base;

said base having a top wall with a recess formed in the upper surface thereof, said recess having opposing side surfaces and a concave generally arcuate surface extending between said side surfaces with serrations formed on at least a portion of said arcuate surface;

and said side surfaces including arcuate rib portions extending into said recess in overlying relation with the edges of said arcuate surface defining guide channels at opposite sides of said recess;

attachment means for releasably securing the applicator pad to said base;

said handle including a hand grip portion and a mounting portion at one end of said hand grip portion;

said mounting portion including first and second arcuate guide means on opposite outer side surfaces of said mounting portion constructed and arranged to be received in said guide channels of said recess for attaching said handle to said base, permitting pivotal movement of said handle relative to said base;

and said mounting portion having locking means including a convex arcuate tongue member cantilever mounted on said mounting portion at the bottom thereof and having a convex arcuate outer surface overlying said concave serrated surface of said recess and having a plurality of serrations thereon, and cam means pivotally mounted on said mounting portion for movement between locking and unlocking positions to drive the serrated outer surface of said tongue portion into and out of engagement, respectively, with the serrated surface of said recess;

said handle being pivotally moveable relative to said base when said locking means is at said unlocking position, and said handle being locked in position when said locking means is at said locking position.

* * * * *

UNITED STATES PATENT AND TRADEMARK OFFICE

CERTIFICATE OF CORRECTION

PATENT NO. : 4,819,294

DATED : April 11, 1989

INVENTOR(S) : Peter W. Calvert

It is certified that error appears in the above-identified patent and that said Letters Patent is hereby corrected as shown below:

Column 2, line 52 "advantage" should be -- advantages --;

Column 8, line 31, "aids" should be -- said --;

Column 8, line 35, "plain" should be -- paint --;

Column 9, line 31, "am" should be -- cam --;

Column 9, line 36, after the first occurrence of "said" insert -- upper --;

Column 9, line 49, "abuse" should be -- base --.

Signed and Sealed this

Twenty-eighth Day of November 1989

*Attest:*

JEFFREY M. SAMUELS

*Attesting Officer*

*Acting Commissioner of Patents and Trademarks*